US006276175B1

(12) United States Patent
Browder, Jr.

(10) Patent No.: US 6,276,175 B1
(45) Date of Patent: Aug. 21, 2001

(54) SEAMLESS TORSO CONTROLLING GARMENT AND METHOD OF MAKING SAME

(75) Inventor: George Alexander Graham Browder, Jr., Winston-Salem, NC (US)

(73) Assignee: Sara-Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/301,854

(22) Filed: Apr. 29, 1999

(51) Int. Cl.[7] ..... D04B 1/24; A41B 9/06
(52) U.S. Cl. ..... 66/171; 2/409
(58) Field of Search ..... 66/171, 175, 176, 66/177; 2/401, 409; 450/156

(56) References Cited

U.S. PATENT DOCUMENTS

| | | | | |
|---|---|---|---|---|
| 2,736,036 | | 2/1956 | Sinigagliesi . | |
| 3,425,246 | | 2/1969 | Knohl . | |
| 3,906,754 | | 9/1975 | Sackman . | |
| 4,663,946 | * | 5/1987 | Wright | 66/177 |
| 5,479,791 | | 1/1996 | Osborne . | |
| 5,572,888 | | 11/1996 | Browder, Jr. et al. . | |
| 5,590,548 | | 1/1997 | Osborne . | |
| 5,592,836 | | 1/1997 | Schuster et al. . | |
| 5,605,060 | | 2/1997 | Osborne . | |
| 5,787,512 | * | 8/1998 | Knox | 66/171 |
| 5,787,732 | * | 8/1998 | Perron et al. | 66/177 |
| 5,850,745 | * | 12/1998 | Albright | 66/176 |

* cited by examiner

*Primary Examiner*—Andy Falik
(74) *Attorney, Agent, or Firm*—Ohlandt, Greeley, Ruggiero, & Perle, LL

(57) ABSTRACT

A circular knit blank for use in the manufacture of undergarments and the garments so manufactured comprising a tubular knit body having an elastomeric yarn on selected courses, wherein said tubular body contains at least one area of control that has a stitch pattern increasing its modulus by about 8%, to provide a balance of comfort and control. The stitch pattern is preferably a 1 by 1 alternating tuck.

18 Claims, 6 Drawing Sheets

SEAMLESS TORSO CONTROLLING GARMENT AND METHOD OF MAKING SAME

BACKGROUND OF THE INVENTION

1. Field of the Invention

The present invention relates generally to a control garment and a method for providing additional control to selected portions of a garment. More particularly, the present invention relates to seamless garments provided with additional control through the use of elastomeric yarn and purpose-specific knitting techniques, and methods for providing such control.

Consumers desire an undergarment that provides control or support in specific areas of the body, such as hips and waist, and is not bulky or unsightly.

2. Description of the Prior Art

Previously known techniques used for adding support to an undergarment include that disclosed in U.S. Pat. No. 2,736,036 to Sinigagliesi. This patent provides a seamless undergarment knitted as a single piece of tubular knitted fabric, but containing a strengthening patch.

U.S. Pat. No. 3,425,246 to Knohl provides a knitted brassiere having extra courses of elastic yarn knitted into the breast cups to shape the cups by providing fullness therein.

U.S. Pat. No. 3,906,754 to Sackman provides an undergarment having a plurality of integrally knitted panels. Each panel extends circumferentially around the garment. Certain of the courses of each panel are knitted of elastomeric yarn to impart an elastic character to the area.

A more recent technique for imparting support to selected area of garments is shown in U.S. Pat. No. 5,479,791 to Osborne. This patent provides a brassiere having a support area between the pair of breast cups in which the courses vary between simple knits, such as plain knit, and welt knit, such as miss-stitch.

U.S. Pat. No. 5,572,888 to Browder, Jr. et al. provides a seamless undergarment knit from a first yarn. A control area is formed by knitting in a second, heavier yarn on designated courses along with the first yarn. A predetermined configuration of plain jersey stitch loops and tuck loops are utilized in the control area to achieve the characteristics of a foundation garment.

U.S. Pat. No. 5,590,548 to Osborne provides a circularly knit legged panty having knit-in shaping panels. The panels are formed by modifying the knit structure in selected areas to form regions having a greater resistance, particularly coursewise resistance, to stretch than the remainder of the tubular body. The patent provides that greater resistance to stretch can be accomplished by using conventional knitting structures, such as floating in an elastic yarn or tucking a yarn in selected alternating courses.

U.S. Pat. No. 5,592,836 to Schuster et al. provides a brassiere having at least two support panels formed by tucking specific stitches for a predetermined number of courses and extending generally walewise, thus, giving greater resistance to coursewise stretch. Preferably, each support panel is described as preferably located on the outside edge of a breast cup and roughly in the form of a "C" partially encircling the breast cup.

U.S. Pat. No. 5,605,060 to Osborne provides a circularly knit body suit in which the middle torso portion is knit with a predetermined cross-stretch that is less than that of the breast supporting section of the garment.

However, a perpetual need exists for improved seamless undergarment provided with control areas shaped specifically to affect certain areas of the body, such as the hips, waist, and even under a woman's breasts. All such control areas need to be formed integrally with the garment so as to appear as an aesthetic, non-bulging feature and, thus, no different than the remainder of the integral garment.

BRIEF SUMMARY OF THE INVENTION

It is the object of the present invention to provide an improved seamless garment having areas of additional control that are shaped to affect specifically chosen areas of the body.

It is another object of the present invention to provide such a garment that has a control area formed by an alternating tuck stitch pattern in the undergarment.

It is yet another object of the present invention to provide such a garment in which the tuck stitch pattern is a 1 by 1 (1×1) alternating tuck stitch.

It is a further object of the present invention to provide such a garment as an undergarment.

It is still a further object of the present invention to provide a method of manufacturing the blank and the garment of the type set forth herein.

In accordance with the present invention, a circular knitting machine knits a single tubular blank including a tubular knit body. The tubular knit body contains an elastomeric yarn added along designated courses. The tension of the elastomeric yarn is constant throughout the entire garment. However, in the area of the garment where increased control is desired, a 1×1 alternating tuck stitch pattern is used. The 1×1 tuck stitch tightens the fabric and increases the modulus of the elastomeric yarn. Thus, the stitch pattern decreases the amount of stretch in the fabric.

DETAILED DESCRIPTION OF THE INVENTION

Figure 1:
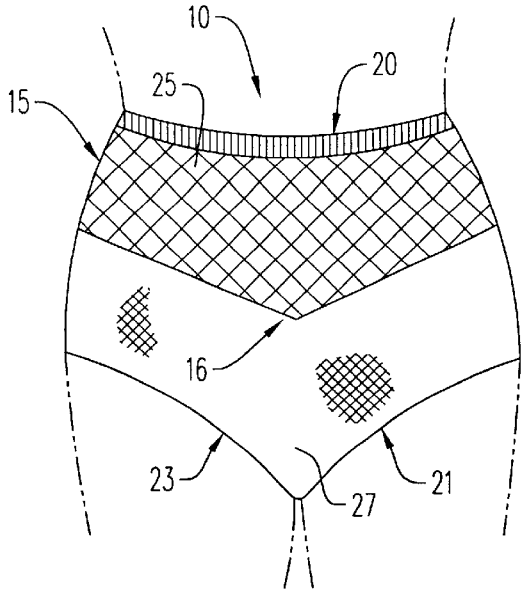
FIG. 1 is a frontal view of a brief that uses the present invention.
Figure 2:
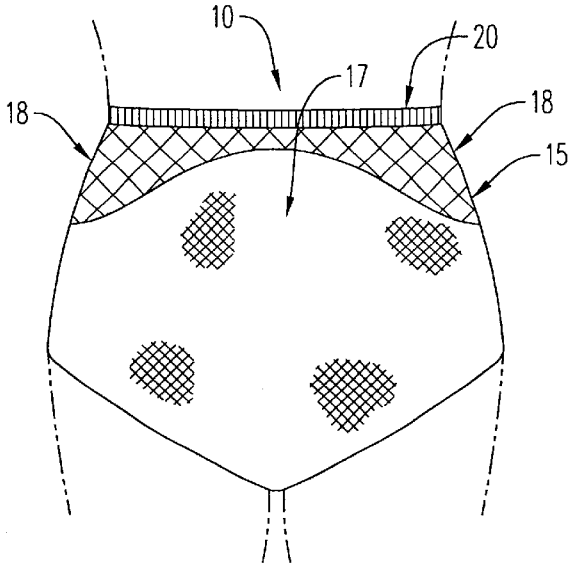
FIG. 2 is a rear view of the brief of FIG. 1.

Referring to the drawings and, in particular FIGS. 1 and 2, there is illustrated a brief according to the present invention generally represented by reference numeral 10. Brief 10, as with all the embodiments of the present invention, is formed as a unitary, seamless knit, tubular garment blank or body 15 having a waistband 20 formed as a turned welt.

The fabric, which forms the turned welt, is knit on circular needles and dial bits in a well-known manner. Knitting machines for producing a fabric in the form of a turned welt are widely used in the industry, and their construction and mode of operation are well known. Alternatively, waistband 20 may be an attached piece of elastic banding. As stated below, waistband or torso-band 20 is made of a combination of nylon covered spandex and nylon. Most preferably, torso-band 20 is made of about 265 to about 420 denier nylon covered spandex and nylon. Such a high denier spandex is preferred in order to make certain that brassiere 130 stays in place on the wearer's body.

Brief 10 is preferably integrally knit to the turned welt. The tubular knit body 15 has a front portion 16, a rear portion 17, and side portions 18. Additionally, the undergarment or brief 10 can have binding or trim that aesthetically finishes and more comfortably defines the leg openings 21 and 23.

Preferably, the undergarment of all embodiments of the present invention, including brief 10, have body 15 made of either nylon microfiber in the about 40 to about 120 denier range or about 40/1's to about 60/1's cotton yarn. Such yarns provide softness, comfort, and desired wicking properties. The knit construction may be any combination of conventional knit, stitches.

The body 15 of brief 10, as with the bodies of all embodiments of the present invention, includes an elastomeric yarn, such as spandex. Preferably, the elastomeric yarn is knit throughout the garment at an even tension. More preferably, the tension of the elastomeric yarn is about 5 to about 7 grams throughout the garment. The elastomeric yarn is preferably spandex, and most preferably about 70 denier spandex.

Control area 25 is an area of the undergarment, in this example brief 10, where increased control is desired. Increased control in control area 25 is accomplished by tightening the fabric of body 15 of brief 10 by using a 1 by 1 (1×1) alternating tuck stitch pattern. Thus, the 1×1 alternating tuck stitch pattern increases the modulus of the fabric. By increasing the modulus of the fabric, the fabric stretches less and controls more. Preferably, the modulus of the fabric is increased between about 6% and about 10%, more preferably about 8%. Increasing the modulus by about 8% provides a desirable compromise between control and comfort.

Control area 25 of brief 10 is apron shaped, covering only the stomach area and the area of the hips, then gradually transitioning over the rear portion, ultimately becoming a relatively narrow, horizontal band integral to welt 20. The border between control area 25 and crotch portion 27 may be of any functional and aesthetically pleasing shape.

Figure 3:
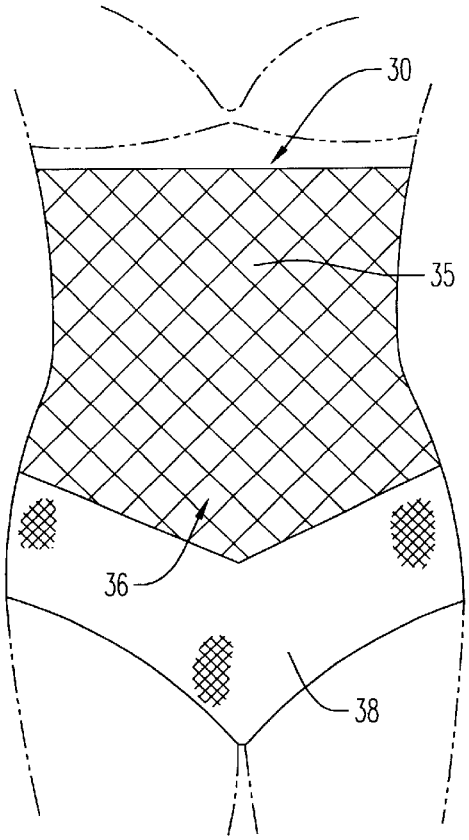
FIG. 3 is a frontal view of a high waist brief that uses the present invention.
Figure 4:
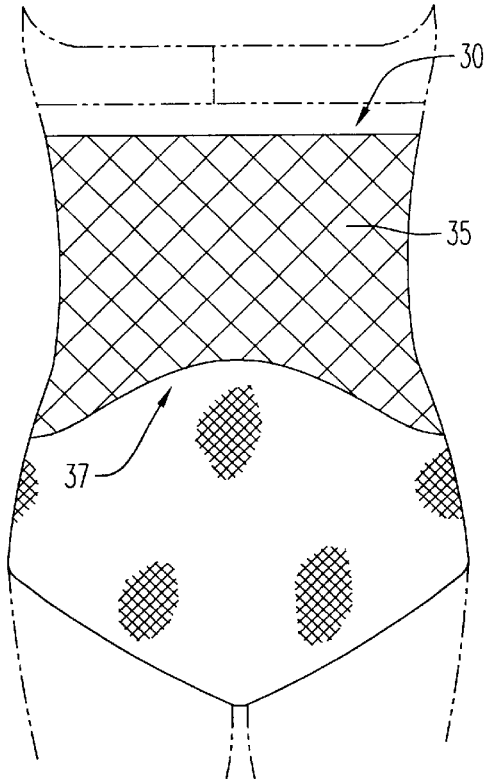
FIG. 4 is a rear view of the high waist brief of FIG. 3.

FIGS. 3 and 4 illustrate a high waist brief 30 according to the present invention. High waist brief 30 is knit using the same method as that for the brief 10. However, control area 35 of high waist brief 30 is extended over the abdomen and ends below the wearer's breasts. Thus, the entire abdominal area, and an area, preferably all, of the hips are covered. Control area 35 is relatively smaller over rear portion 37 of high waist brief 30 with a rounded transition area extending from front portion 36 of the high waist brief and over the rear portion. The border between control area 35 and crotch portion 38 may be of any functional and aesthetically pleasing shape.

Figure 5:
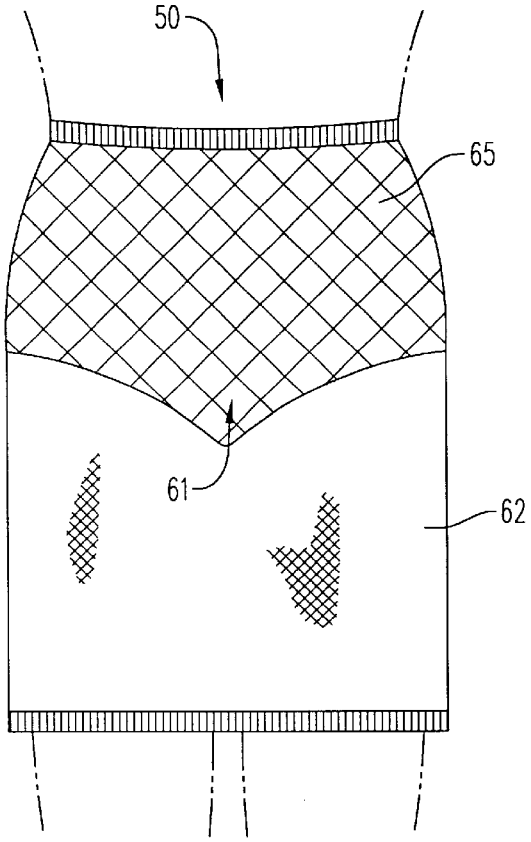
FIG. 5 is a frontal view of a half-slip that uses the present invention.
Figure 6:
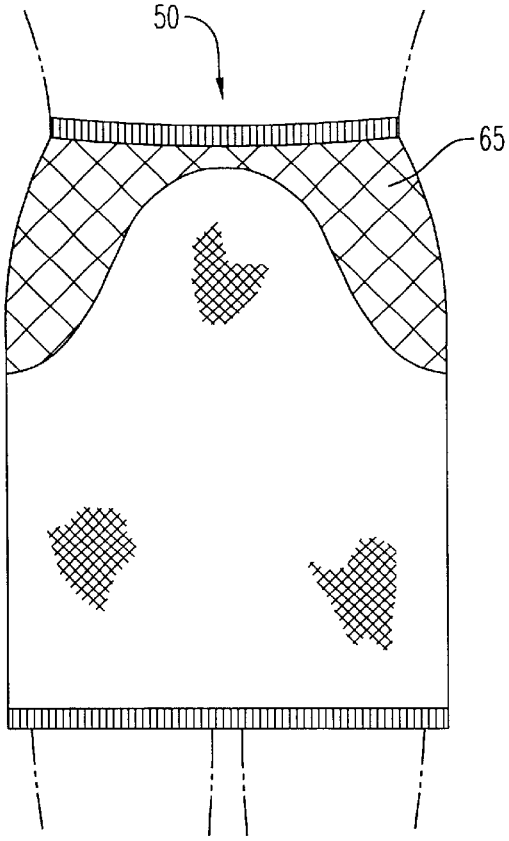
FIG. 6 is a rear view of the half-slip of FIG. 5.

FIGS. 5 and 6 show a half-slip 50 according to the present invention. Half-slip 50 is knit using the same method as that of the embodiments of FIGS. 1 through 4, but absent the leg openings. Control area 65 of half-slip 50 is shaped similarly to control area 25 of brief 10 and high waist brief 30. On the front portion 61 of half-slip 50, the border between control area 65 and skirt portion 62 is angled. However, the border between control area 65 and skirt portion 62 may be of any aesthetic or functional shape. It is preferable that half-slip 50 has a first waistband 52 at the waist of the half-slip and a second bond 54 at the lower end of the half-slip. The waistband 52 is a turned welt waistband that is integrally formed with half-slip 50. Likewise, band 54 is also a turned welt integrally formed with half-slip 50. As with waistband 20 shown in FIGS. 1 and 2, first waistband 52, as well as band 54, are preferably a combination of nylon covered spandex and nylon, with the most preferred being about 265 to about 420 denier nylon covered spandex and nylon.

Figure 7:
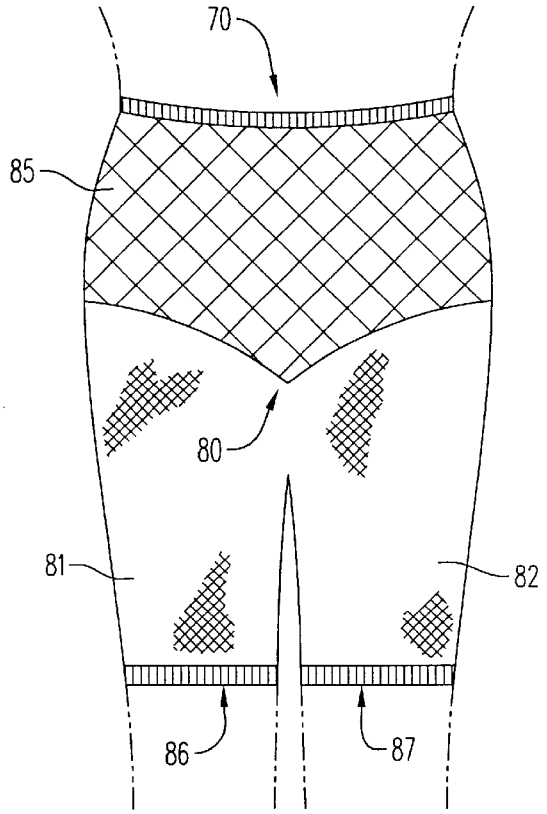
FIG. 7 is a frontal view of a thigh-slimmer that uses the present invention.
Figure 8:
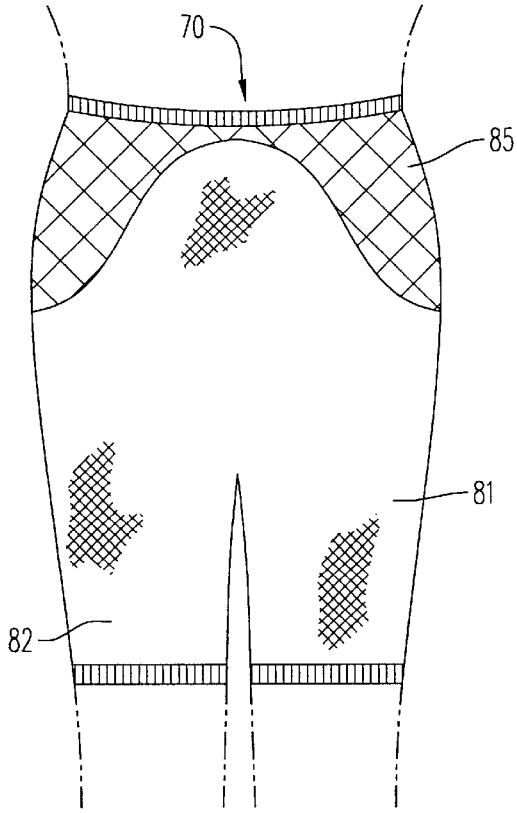
FIG. 8 is a rear view of the thigh-slimmer of FIG. 7.
Figure 9:
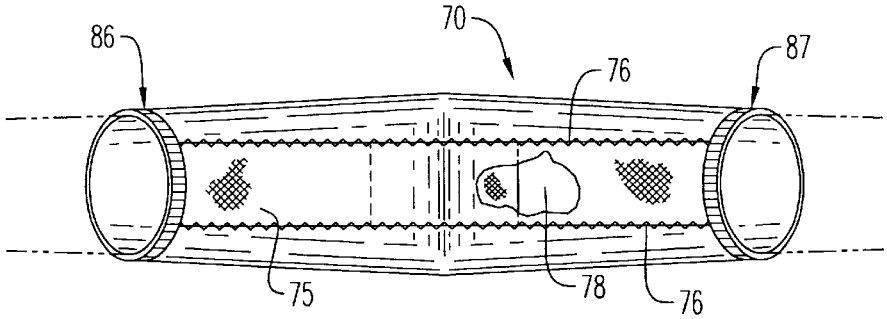
FIG. 9 is a bottom view of the thigh-slimmer of FIG. 7, but with the legs expanded.

FIGS. 7 and 8 show a thigh-slimmer 70 according to the present invention. The thigh-slimmer 70 is knit using the same method as the undergarments of FIGS. 1 through 6. Control area 85 is shaped similarly to control area 65 in FIGS. 5 and 6. Optionally, control areas may be placed on leg portions 81 and 82. In addition, leg portions 81 and 82 are seamlessly knit to front portion 80. The thigh-slimmer 70 can have binding or trim that aesthetically finishes and more comfortably defines leg openings 86 and 87. In an alternative embodiment shown in FIG. 9, thigh-slimmer 70 may include a seamed gusset panel 75 to improve fit and comfort. The gusset panel 75 is made of the same material as the body of thigh-slimmer 70, but preferably also includes a cotton liner 78. The gusset panel 75 is sewn to thigh-slimmer 70 also sew lines 76 so that cotton line 78 is either rapped about the gusset panel, or positioned between the gusset panel and the underside of thigh-slimmer 70.

Figure 10:
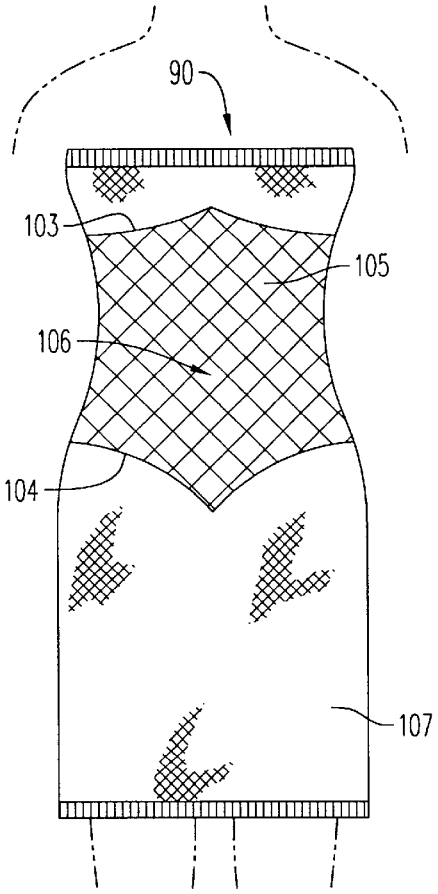
FIG. 10 is body-slip that uses the present invention.

In FIG. 10, there is illustrated a body-slip 90 according to the present invention. Body-slip 90 is knit by the method used for the undergarments of FIGS. 1 through 8. Control area 105 is apron shaped, but extends over the abdomen and ends below the wearer's breasts. The borders of control area 105 are shaped to follow the shape of the wearer. Thus, the abdominal area, and the area of the hips are covered. Front portion 106 has an upper border 103 of control area 105 that may be scalloped to follow the breast line and a lower border 104 of control area 105 that is scalloped to allow less restricted movement of the wearer's legs. Control area **25*b* is relatively smaller over rear portion 107 of body slip 90 with a rounded transition area extending from the front portion 106 and over the rear portion 107. On the front portion of body slip 90, the border between control area 105 and skirt portion 107 is angled. However, the border between control area 105 and skirt portion 107** may be of any functional or aesthetically pleasing shape.

Figure 11:
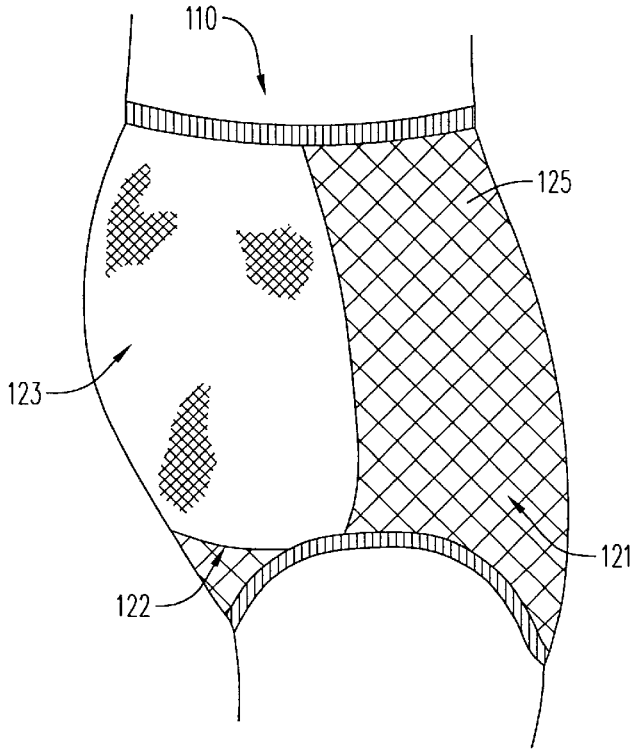
FIG. 11 is a maternity brief that uses the present invention.

FIG. 11 shows a maternity brief 110 according to the present invention. Maternity brief 110 is knit using the method described in reference to brief 10 and high waist brief 11. However, control area 125 extends over rear portion 121 and also extends onto front portion 122 covering the wearer's groin. The portion covering stomach area 123 is specifically knitted without any control area to allow the portion covering the stomach to expand as needed. Thus, control area 125 controls the wearer's buttocks and hips, while simultaneously lifting the wearer's stomach area.

Figure 12:
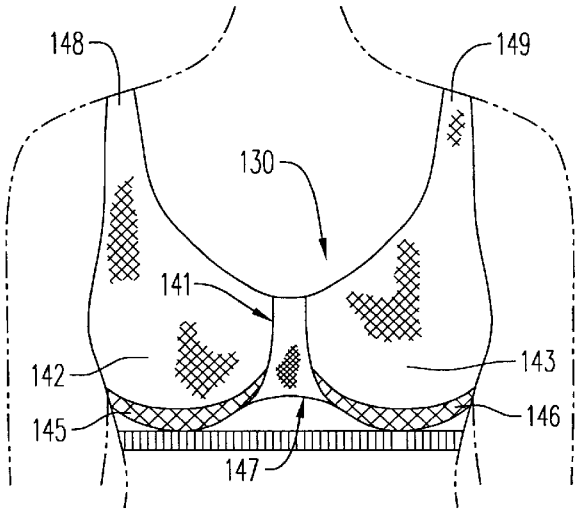
FIG. 12 is a brassiere that uses the present invention.
Figure 13:
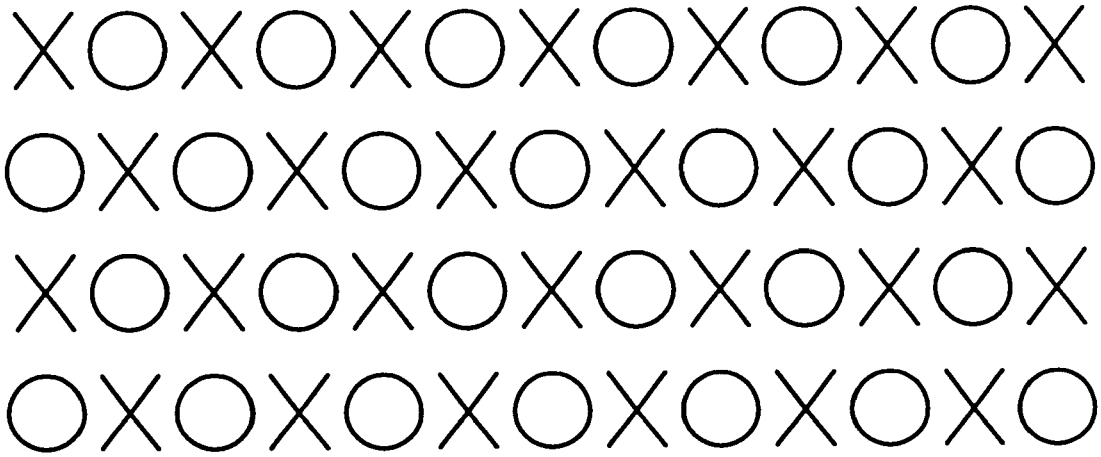
FIG. 13 is a graphic depiction of the 1×1 alternating tuck stitch pattern.

Referring to FIG. 12, there is provided a brassiere 130 having an upper torso part 141. Brassiere 130 is produced from a seamless blank that is formed by a conventional high speed circular knitting machine. Upper torso part 141 is integrally joined to turned welt or torso-band 147 in a seamless manner.

Upper torso part 141 preferably has formed therein breast cups 142 and 143. Upper torso part 141 may also have a first or right strap or strap portion 148, and a second or left strap or strap portion 149, which may be integrally knit.

Turned welt or torso-band 147 is preferably an elastomeric yarn or material. As stated before, more preferably torso-band 147 is made of a combination of nylon covered spandex and nylon. Most preferably, torso-band 147 is made of about 265 to about 420 denier nylon covered spandex and nylon to make certain that brassiere 130 stays in place on the wearer's body.

Upper torso part 141 is, as with the body 15 of brief 10 and the bodies of the other undergarments of the present invention, preferably made of flat nylon ground yarn and a cotton and/or nylon yarn. Flat yarn is used because it has no stretch. The fabric also includes an elastomeric yarn, such as spandex. The combination of yarns forms a pattern that is in the range of 60/1's to 40/1's cotton count or about 40 to about 120 denier, preferably about 80 to about 120. The flat nylon ground yarn is about 20 to about 40 denier, preferably about 20 denier.

Brassiere 130 is formed mostly with simple knit constructions, such as plain, tuck, pearl and combinations thereof. Welt knit stitches may suitably be used to provide special features at various locations. However, in the areas of brassiere 130 where increased control is desired, a 1×1 alternating tuck stitch pattern is used. Such areas are shown generally as 145 and 146. As stated before, the 1×1 alternating tuck stitch pattern tightens the fabric of brassiere 130 and, thus, increases the modulus of the fabric. By increasing the modulus of the fabric, the fabric stretches less and controls more. Preferably, the modulus of the fabric is increased between about 6% and about 10%, more preferably about 8%. Increasing the modulus by about 8% provides a desirable compromise between control and comfort.

In the example illustrated as FIG. 12, control areas 145,146 are narrow bands located underneath breast cups 142,143 and extending coursewise in the area of transition between upper torso portion 141 and torso-band 147. In this way, control areas 145,146 take the place of traditional underwires. However, control areas may also be located in other areas of the brassiere, such as between the cups or on the outside edge of the cups. Additionally, control areas for brassiere 130 need not be shaped as narrow bands. If the purpose of the brassiere 130 is to pull the breast together, an hourglass-shaped control area between the breast cups could be employed.

The present invention having thus been described with particular reference to the preferred forms thereof, it will be obvious that various changes and modifications may be made therein without departing from the spirit and scope of the present invention as defined in the appended claims.

What we claim is:

1. A circular knit blank for use in the manufacture of undergarments comprising a tubular knit fabric having a first stitch pattern and a second stitch pattern with each stitch pattern having an elastomeric yarn knitted therein, said second stitch pattern being a tightening and alternating tuck stitch pattern that forms at least one area of control that increases the modulus of said tubular knit fabric.

2. The circular knit blank according to claim 1 wherein said area of control provides control for a user's hips.

3. The circular knit blank according to claim 1, wherein said stitch pattern is a 1×1 alternating tuck stitch pattern.

4. A lower torso garment comprising a tubular knit fabric having a first stitch pattern and a second stitch pattern with each stitch pattern having an elastomeric yarn knitted therein, said second stitch pattern being a tightening and alternating tuck stitch pattern that forms at least one area of control that increases the modulus of said tubular knit fabric.

5. The lower torso garment according to claim 4, wherein said lower torso garment is a brief having said at least one area of control substantially covering only a user's stomach and hip areas.

6. The lower torso garment according to claim 4, wherein said lower torso garment is a high waist brief having said at least one area of control substantially covering only a user's abdominal and hip areas.

7. The lower torso garment according to claim 4, wherein said lower torso garment is a half-slip having said at least one area of control substantially covering only a user's stomach and hip areas.

8. The lower torso garment according to claim 4, wherein said lower torso garment is a legged brief having said at least one area of control substantially covering only a user's stomach and hip areas.

9. The lower torso garment according to claim 4, wherein said lower torso garment is a body slip having said at least one area of control substantially covering only a user's abdominal and hip areas.

10. The lower torso garment according to claim 4, wherein said lower torso garment is a maternity brief having said at least one area of control substantially covering a user's buttocks, hips, and groin areas, wherein said at least one area of control aids in controlling the stomach area without reducing the ability of the portion of said maternity brief covering the stomach area to expand as needed.

11. A brassiere comprising a tubular knit fabric having a first stitch pattern and a second stitch pattern with each stitch pattern having an elastomeric yarn knitted therein, said second stitch pattern being a tightening and alternating tuck stitch pattern forming at least one area of control that increases the modulus of said tubular knit fabric.

12. The brassiere according to claim 11, wherein said at least one area of control is two areas of control, wherein each of said two areas of control is located underneath a respective breast cup of said brassiere.

13. A method of making a lower torso garment comprising:

knitting a welt portion and a tubular knit body, said tubular knit body made of a fabric having a first stitch pattern and a second stitch pattern with each stitch pattern having an elastomeric yarn knitted therein, said second stitch pattern being a tightening and alternating tuck stitch pattern forming at least one area of control that increases the modulus of said fabric;

knitting an extended portion integrally to said tubular knit body, said extended portion having a distal edge; and attaching said distal edge to said tubular knit body to form leg openings.

14. The method of making a lower torso garment according to claim 13, wherein said modulus is increased by about 8%.

15. The method of making a lower torso garment according to claim 13, wherein said stitch pattern is a 1×1 alternating tuck stitch pattern.

16. A method of making a brassiere comprising:

knitting a welt portion and a tubular knit body, said tubular knit body made of a fabric with a first stitch pattern and a second stitch pattern with each stitch pattern having an elastomeric yarn knitted therein, said second stitch pattern being a tightening and alternating tuck stitch pattern forming at least one area of control that increases the modulus of said elastomeric fabric; and knitting to said tubular knit body extended portions that when attached together form shoulder straps.

17. The method of making a lower torso garment according to claim 16, wherein said modulus is increased by about 8%.

18. The method of making a lower torso garment according to claim 16, wherein said stitch pattern is a 1×1 alternating tuck stitch pattern.

* * * * *